United States Patent [19]

Rehrig

[11] Patent Number: 4,478,344

[45] Date of Patent: Oct. 23, 1984

[54] HAND CARRYING BASKET

[76] Inventor: Houston Rehrig, 4010 E. 26 St., Los Angeles, Calif. 90023

[21] Appl. No.: 461,933

[22] Filed: Jan. 28, 1983

[51] Int. Cl.[3] ..... B65D 21/04

[52] U.S. Cl. ..... 220/83; 220/72; 206/505; 206/507

[58] Field of Search ..... 220/83, 72; 206/505, 206/507, 518, 519

[56] References Cited

U.S. PATENT DOCUMENTS

| | | | |
|---|---|---|---|
| 3,398,840 | 8/1968 | Wilson | 206/505 X |
| 3,434,625 | 3/1969 | Embry, Jr. | 220/72 X |
| 4,308,954 | 1/1982 | Wilson | 206/505 |
| 4,320,837 | 3/1982 | Carroll et al. | 206/505 |
| 4,334,616 | 6/1982 | Wilson | 206/505 |

*Primary Examiner*—Steven M. Pollard

*Attorney, Agent, or Firm*—Banner, Birch, McKie & Beckett

[57] ABSTRACT

An integrally-formed plastic basket, moldable in a two-piece injection mold, combines light weight, strength, and large carrying capacity. Thin side walls with a draft no greater than 3° are formed with overlapping cross-members. Between a pair of unslotted, substantially planar cross-members is a slotted, corrugated cross-member. Interior slots are formed by the core die of the injection mold, while exterior slots are formed by the cavity die.

6 Claims, 7 Drawing Figures

HAND CARRYING BASKET

BACKGROUND OF THE INVENTION

The present invention relates to a process for molding plastic containers and to the article produced by the process. Specifically, it relates to a unitary, injection molded plastic basket produced in a two-piece mold and having light weight, strength, and large carrying capacity.

Generally, the injection molding of a plastic article requires a mold formed of a number of pieces, which when fitted together define a cavity of the shape of the article. The mold is assembled and the cavity filled by forcing liquid thermoplastic material into it. After the plastic has cooled and set, the mold may be disassembled and the plastic article removed, at which time it may require further finishing.

One type of injection molding apparatus is exemplified by Fisher U.S. Pat. No. 3,152,365. This type of mold, called a sliding mold, has several dies which move into and out of engagement with each other in several directions and, possibly, at different times. In Fisher, for example, the injection molding apparatus is designed to produce the handle of a telephone handset. As shown in FIG. 1 of Fisher, in addition to a lower molding die and an upper molding die which move vertically into and out of engagement with each other, the mold includes two core members, forming the transmitter and receiver housings, which are rotated in and out of position along screw threads. The mold also includes two other core members, forming the interior surfaces of the central tubular portion, which must be slid in and out of position around the corners of the transmitter and receiver housings. Because such a mold has multiple members, it is capable of producing a plastic article of relatively complex shape. However, it has the disadvantages that a good deal of time is necessary to move the multiple members into and out of molding position and that the apparatus itself, because it has many moving parts, is relatively expensive. The sliding mold, therefore, is unsuitable for fabricating simple articles such as shopping baskets which are intended to be sold at low cost.

Another type of injection molding apparatus, exemplified by Long U.S. Pat. No. 2,556,590, is the two-piece mold. As its name implies, the mold of this apparatus consists of only two pieces: a core member and a cavity member. Furthermore, in the two-piece mold the core and cavity members are moved into and out of engagement in a single direction. The interior surface of the cavity, and the exterior of the core, when the two dies are placed together, define the shape of the plastic article. Because the two-piece mold has no moving parts, it is inexpensive both in initial cost and in operation and is therefore capable of producing an inexpensive plastic article. Its chief disadvantage arises from the need to withdraw the core die from the cavity die along a single direction. Because of this feature, plastic articles produced in a two-piece mold generally may not have vertical walls, that is, walls which extend in the direction of separation of the two dies. When vertical walls are attempted, they are torn from the rest of the article as the dies are separated. Typically, therefore, to facilitate separation of dies, the walls of the plastic article are designed with a considerable amount of draft, or taper. In fact, it is generally considered that such walls may be no closer than six degrees to the vertical without assuming substantial risk of destruction of the plastic article when the mold is separated.

There is also a relationship between the thickness of the wall and the amount of draft necessary to ensure its integrity upon mold separation. Generally, thinner walls require a greater draft. The reason for this is apparent. The thinner a wall, the lower the maximum shear force it can sustain without breaking. Ideally, for a wall of infinitesimal draft, when mold separation occurs the dies instantaneously separate from the molded article and no shear forces are applied to the article. Practically, however, there are attractive forces between the surface of the dies and the surface of the article, forces which decrease with the distance between the surfaces. The shallower the draft of the wall, the closer the surfaces are for a given distance of mold separation and the greater the force on the article tending to part it. Such shallow drafts, therefore, have previously required thicker walls to withstand the forces of mold separation. A problem develops, therefore, in designing a lighter weight, lower cost basket by thinning the walls. If the only weight-reduction measure taken is to reduce the thickness of the basket walls, their draft must be simultaneously increased. For a given maximum size of basket, thinner walls and a greater draft necessarily result in a smaller carrying capacity.

To overcome this problem of the relationship between wall thickness, draft, and weight, solid, thin walls have been replaced by thicker, slotted walls, as shown in the previously-mentioned Long patent. Molding the basket with slots in its walls has the added advantages that the contents are more visible and that they are ventilated. On the other hand, slots present their own set of problems, especially in molding a basket using a two-piece mold. Not only is the draft of the basket walls important, but the draft of the edges of the slots likewise must be controlled to avoid destruction of the article as the mold is separated. The same reasons apply here as were discussed above in connection with wall thickness. Because of the attractive forces between the dies and the edges of the slots, the slot edges must have sufficient draft to withstand mold separation.

SUMMARY OF THE INVENTION

It is therefore an object of the present invention to provide a unitary plastic basket suitable for injection molding in a two-piece mold.

It is another object of the present invention to provide such a basket whose side walls have a relatively small degree of draft or taper, thereby enabling the basket to be constructed with a large interior volume.

Another object of the present invention is to provide such a basket with thin, slotted side walls to decrease the weight and cost of the basket.

A further object of the invention is to provide such a basket with special side wall construction to increase the strength of the side walls.

The present invention is a unitary plastic basket which may be used, for example, to carry groceries by hand in a supermarket and which, because of its design, is suitable for injection molding in a two-piece mold. The side walls of the basket are tapered only three degrees; herefore, the bottom has an area which is a comparatively large fraction of the area of the top opening of the basket. This allows the basket of this invention to hold a larger volume than achieved with prior art designs.

Light weight is achieved partly by making the side walls of the basket thin and partly by forming slots in them; strength in the thin, slotted side walls is preserved by corrugating the slotted cross-member of the side walls and overlapping this corrugated, slotted cross-member with substantially planar, unslotted cross-members to form a strong, light weight side wall. Corrugation of the slotted side wall cross-member has been found to increase its strength at least sufficiently to overcome the effects of introducing slots into the member; overlapping it above and below with a substantially planar, unslotted cross-member increases its strength even further.

The corrugated cross-members of the side walls comprise interior and exterior panels, and a slot is placed in each panel. A corrugated cross-member is overlapped along both its upper edge and its lower edge with a substantially planar, unslotted cross-member, the unslotted cross-member along the upper edge being overlapped on the outer surface of the corrugated cross-member while the lower unslotted cross-member overlaps the inner surface of the corrugated cross-member. Slots in the interior panels of the corrugated cross-member extend upward from the lower, unslotted cross-member through the upper edge of the corrugated cross-member. Slots in the exterior panels of the corrugated cross-member extend downward from the upper, unslotted cross-member through the lower edge of the corrugated cross-member. In other words, interior slots, those in interior panels, have a bottom edge formed by the lower unslotted cross-member, but no top edge. Exterior slots, on the other hand, have a top edge formed by the upper unslotted cross-member, but no bottom edge.

This construction allows the basket of the present invention to be molded in a two-piece injection mold. Instead of a substantially planar side wall, the present invention uses a side wall of at least three cross-members overlapped with each other so that higher cross-members overlap the outside top edge of the cross-members below them. This layered construction allows a wall with only a three degree draft to be formed instead of the prior art's six-degree-draft wall. By dividing the side walls into a number of sections according to this invention, mold separation is made easier, for a given amount of draft, and draft can accordingly be decreased, leading to a basket of larger interior volume.

Another feature which facilitates injection molding is corrugation of the slotted cross-member. Interior slots are formed entirely by the core (upper) die of the mold, which, when the mold is opened, is pulled up and out of the basket. Mold separation is aided by the open-ended nature of the tops of the interior slots—having no top edge, the interior slots allow the core of the mold to be simply lifted out of the slots. The same relationship exists between the cavity (bottom) die and exterior slots. Since they are open-ended at the bottom and formed entirely by the cavity die, the basket may simply be lifted from the cavity, sliding the exterior slots from the slot-forming sections of the cavity. Side edges of the slots have a one degree draft to permit mold separation.

DETAILED DESCRIPTION OF THE PREFERRED EMBODIMENT

Figure 1:
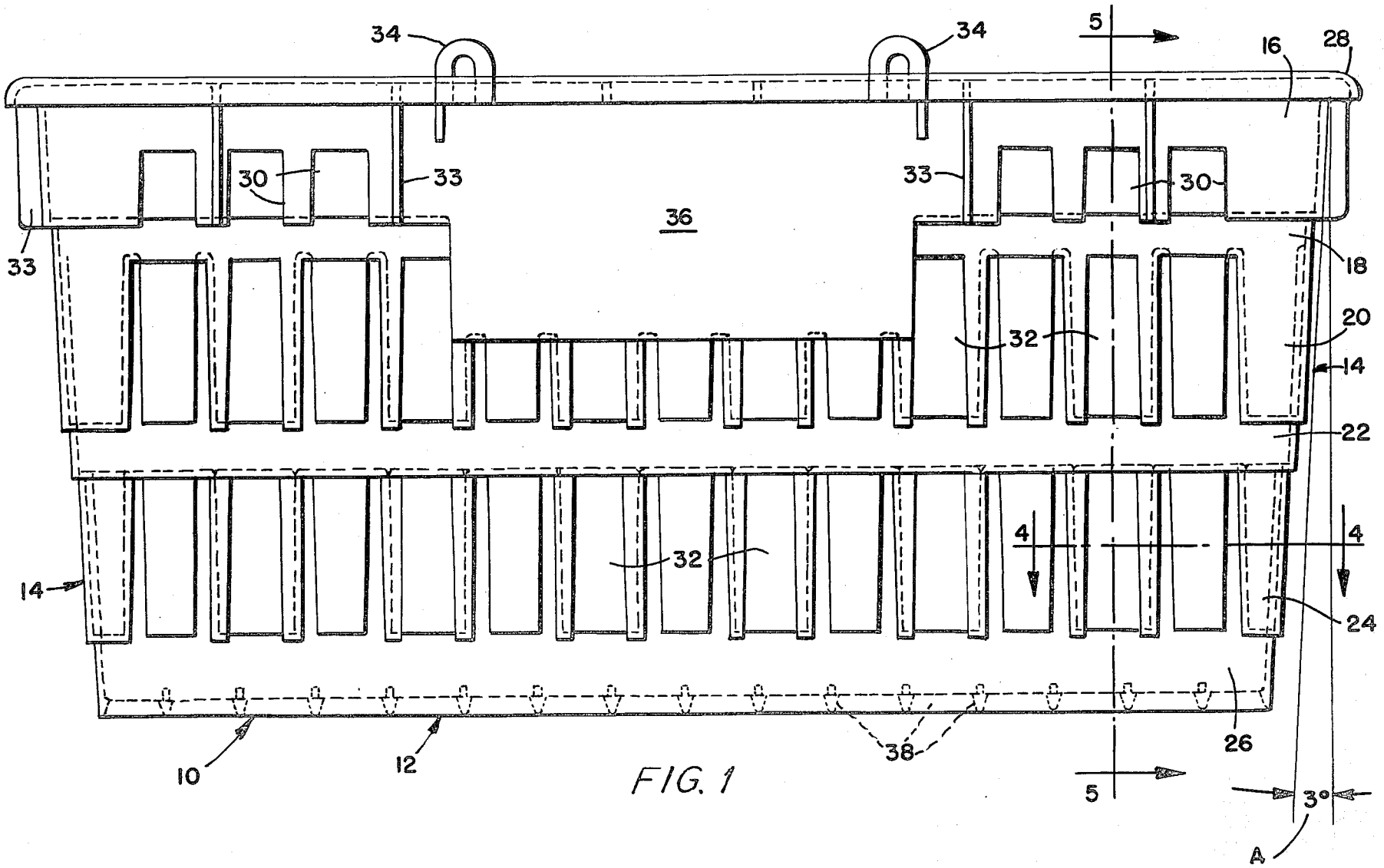
FIG. 1 is a side elevational view of the basket of this invention.
Figure 2:
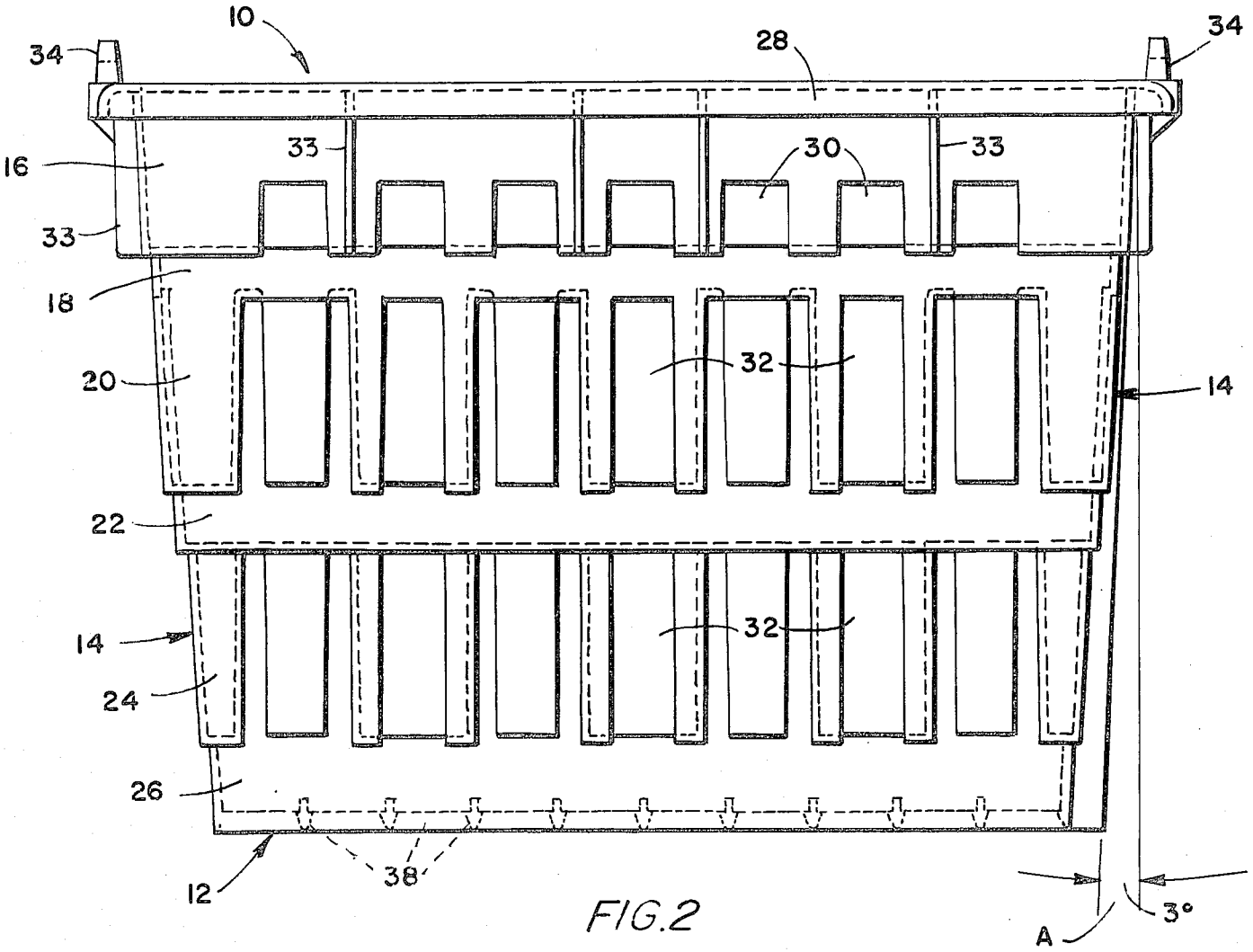
FIG. 2 is an end elevational view of the basket.

In FIG. 1, the side view of the hand carrying basket of the present invention, the relative steepness of the sides (small draft) which may be achieved with the present invention is apparent. The basket, indicated generally at 10, has a bottom wall 12 and side walls 14. As dimension A shows, the side walls have a three degree draft, or inclination from the vertical, to allow separation of the core die from the basket and the basket from the cavity die upon conclusion of the injection molding process. This small draft allows base 12 to have a comparatively large area in relation to the opening at the top of the basket, and in consequence of this, the interior volume of the basket is large. The side wall visible in FIG. 1 is seen to be formed with six cross-members, numbered 16 through 26. In addition, at the top of side wall 14, a rolled top edge 28 is provided for strength and smoothness.

The uppermost cross-member 16 extends downwardly from rolled edge 28 to cross-member 18 below it. Cross-member 16 contains slots 30 to decrease the weight of the basket and ribs 33, integrally formed with rolled edge 28, to strengthen both cross-member 16 and edge 28. Below cross-member 16 are, in order, unslotted cross-member 18, slotted cross-member 20, unslotted cross-member 22, slotted cross-member 24, and unslotted cross-member 26. Slotted members 20 and 24 contain slots 32, also to reduce the weight of the basket. As shown in FIG. 1, slotted members 20 and 24 are each bounded at their upper and lower edges by an unslotted cross-member (e.g., 18, 22); this arrangement maintains the strength of the basket's side walls. On top of two opposite side walls of the preferred embodiment, a pair of eyelets 34 are integrally formed with the basket. Eyelets 34 serve as attachment points for the carrying handles (not shown) which enable this basket to be used for the hand carrying of articles such as groceries. Beneath eyelets 34, a portion of side wall 14 is left unslotted and serves as an identification space 36. Here, the owner of the baskets (such as a supermarket chain) may have its name embossed in order to reduce the possibility of theft.

Figure 3:
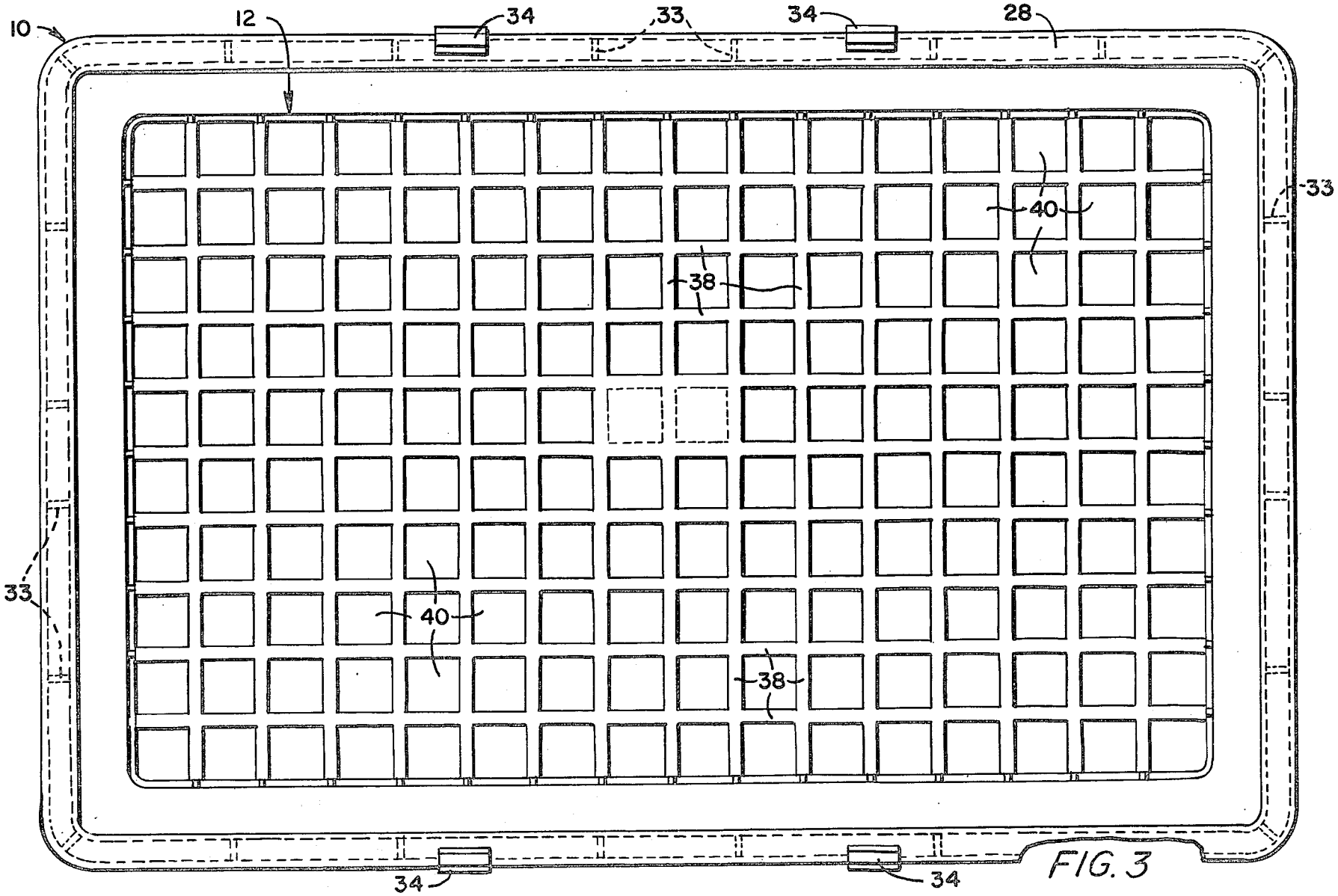
FIG. 3 is a top plan view of the basket.

Bottom wall 12 of the basket, as shown in FIG. 3, is of lattice construction to further reduce the basket's weight. The lattice is formed of a plurality of intersecting ribs 38 defining a plurality of spaces 40 between them. Also visible in FIG. 3 is rolled top edge 28 extending around the entire periphery of basket 10 to reinforce the top edge of the basket. In FIG. 3, the details of the side walls are omitted for the sake of clarity.

Figures 4, 6:
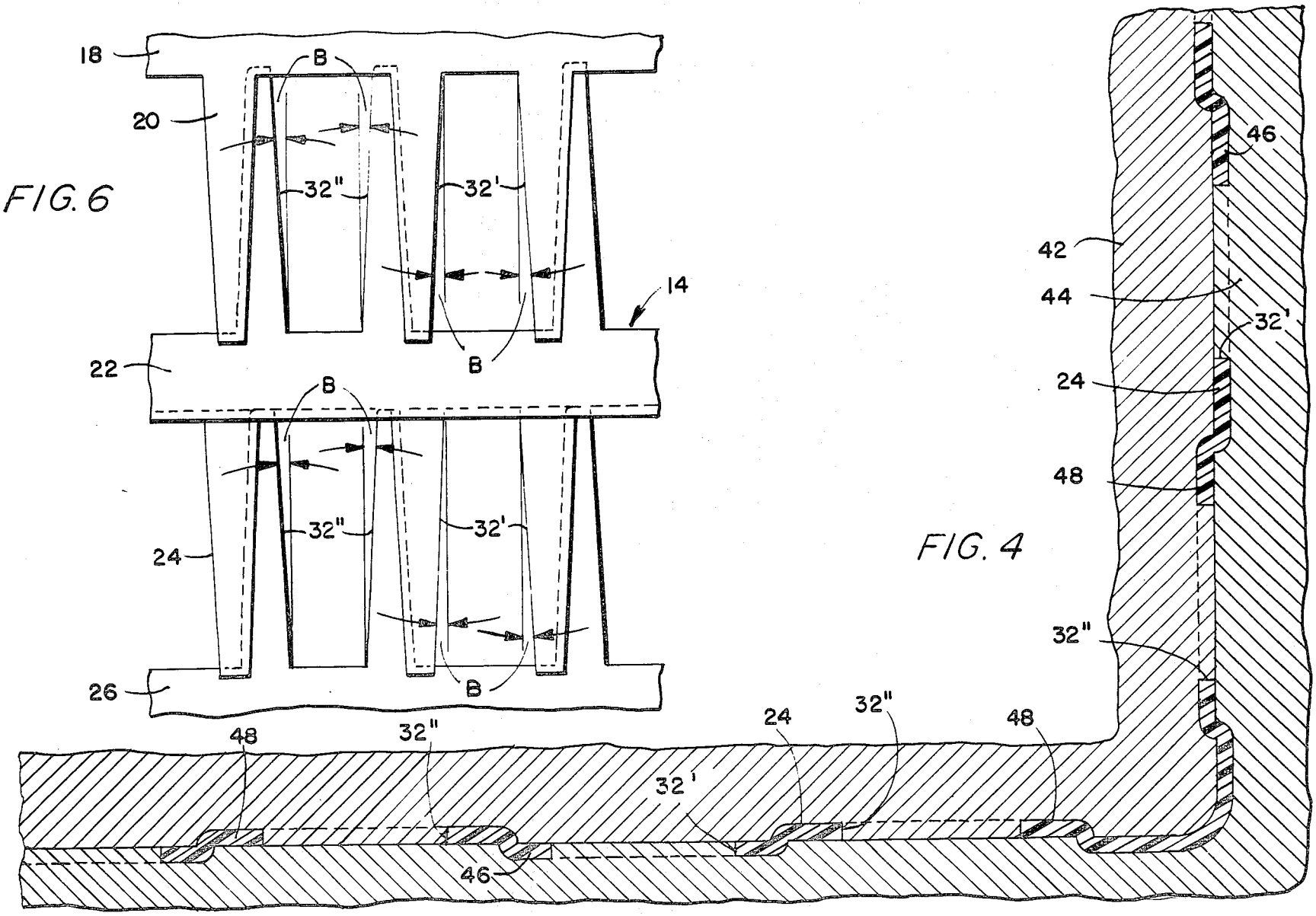
FIG. 4 is a horizontal sectional view of the basket taken along line 4—4 of FIG. 1, but with the addition of fragments of the dies that would be used to form the basket.
FIG. 6 is a schematic side elevation of a fragment of the basket with the slope of the sides of the trapezoidal openings exaggerated to illustrate the fact that the sides of the inner openings diverge upwardly and the sides of the outer openings diverge downwardly in order to facilitate easy separation of the dies from the basket.

The special side wall construction which strengthens the slotted cross-members of the sidewalls is shown in FIG. 4. A portion of basket 10 is illustrated in an injection mold consisting of core die 42 and cavity die 44 together defining the space which, when filled with plastic, becomes basket 10. This section through a slotted cross-member of two side walls 14 clearly depicts the corrugation of the side walls which gives them their strength. The corrugated cross-members have exterior panels 46 alternating with interior panels 48 in which are formed slots 32. Exterior panels 46 contain exterior slots 32', while interior panels 48 contain interior slots 32''. It can be seen from FIG. 4 that exterior slots 32' are formed by the cavity member 44 of the injection molding dies, whereas interior slots 32'' are formed by the core member 42 of the dies.

Figure 5A:
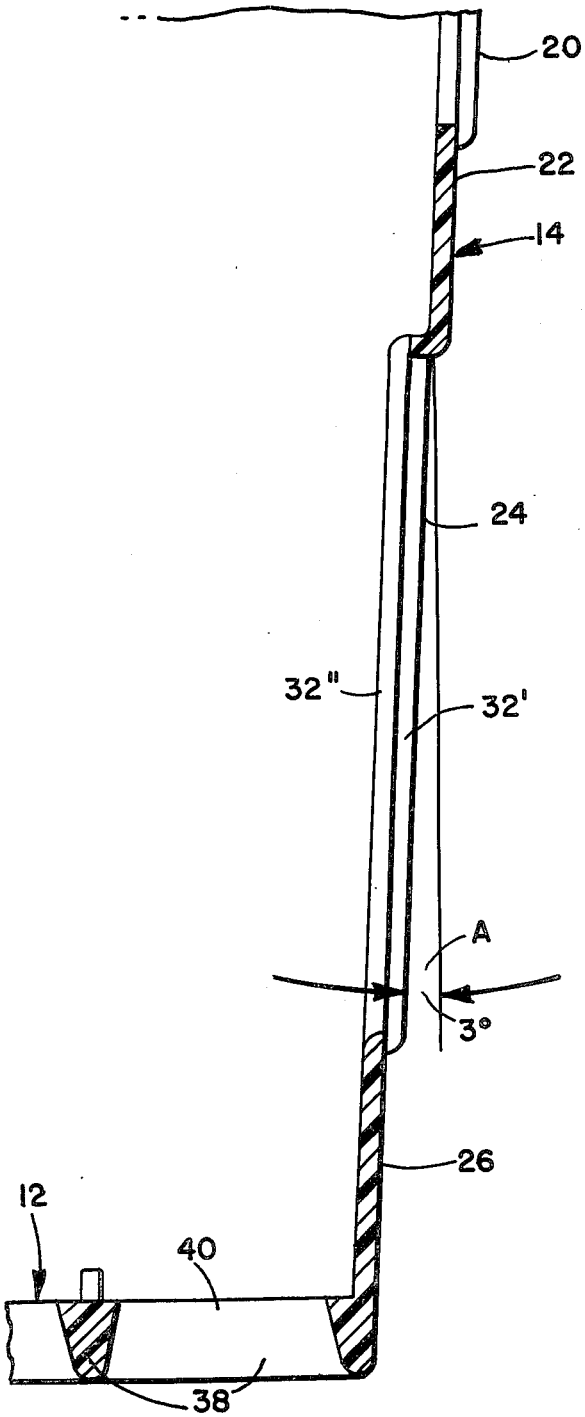
FIGS. 5A and 5B are enlarged sectional views taken along the line 5—5 of FIG. 1.
Figure 5B:
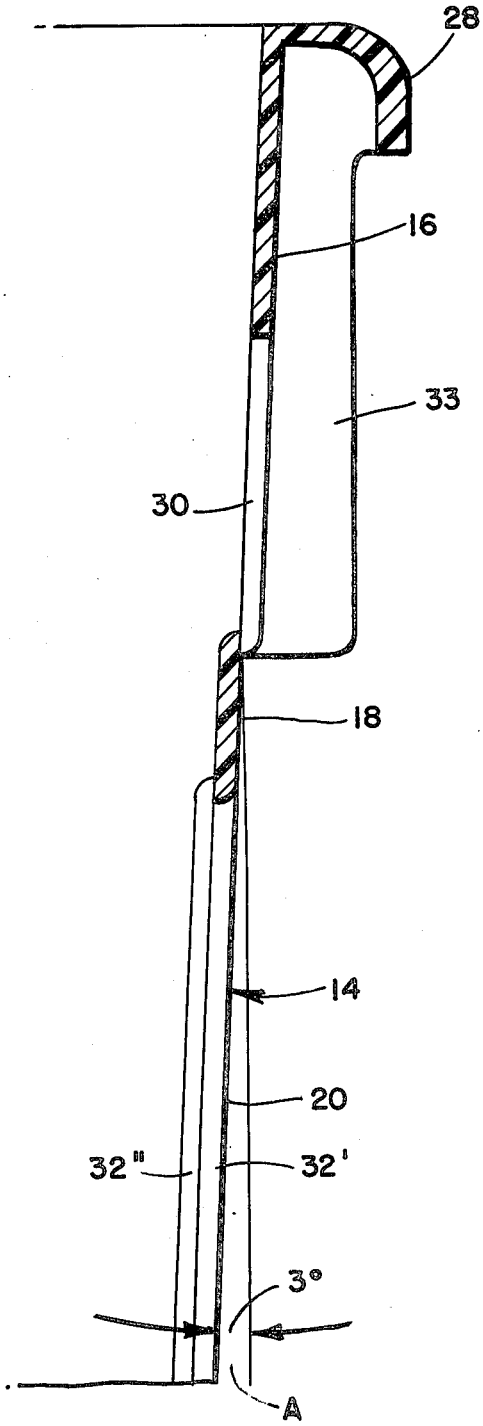

FIGS. 5A and 5B show how the various cross-members of the side walls 14 are joined to form a strong wall having a small draft. Top cross-member 16 is formed integrally with ribs 33 and rolled edge 28 to provide increased strength to compensate for the formation of slots 30. Cross-member 16 overlaps, at its lower edge, with the upper edge of unslotted cross-member 18. Member 18, in addition to being unslotted, is substantially planar and provides strength between slotted cross-members 16 and 20. Overlapping with the bottom edge of cross-member 18 is the top edge of slotted cross-member 20. Because member 20 is slotted, added strength is provided by corrugating it in the manner shown in FIG. 4. Exterior slots 32' are formed in exterior panels (not shown) of slotted cross-member 20, while interior slots 32'' are formed in interior panels (not shown) of member 20. The bottom edge of member 20 is overlapped with the top edge of unslotted cross-member 22. Like unslotted cross-member 18, member 22 is substantially planar and provides strength between adjacent slotted cross-members. The bottom edge of cross-member 22 overlaps with the top edge of slotted cross-member 24. Like slotted cross-member 20, member 24 is corrugated to provide additional strength to compensate for its slots. Cross-member 24 also has exterior slots 32' in the exterior panels of its corrugations and interior slots 32'' in the interior panels. Finally, the bottom edge of member 24 overlaps with the top edge of unslotted cross-member 26. Member 26 is a substantially planar, unslotted cross-member which is integrally formed with bottom wall 12 of the basket.

FIGS. 5A and 5B illustrate how the design of the present invention facilitates mold separation. Slots formed by the cavity die have a top edge but no bottom edge (i.e., they are open-ended at the bottom). Because of this, the basket may simply be raised from the cavity, and the slot-forming portion of the cavity die can slide out of the bottom of the slot. For example, substantially planar unslotted cross-member 22 forms the top edge of slot 32' in slotted cross-member 24; however, no member forms a bottom edge of slot 32', so that it is open-ended at its bottom. In contrast, slots formed by the core die have a bottom edge but no top edge (are open-ended at the top). Because of this, the core may simply be raised from the basket, and the slot-forming portion of the core die can slide out of the top of the slot. For example, substantially planar unslotted cross-member 22 forms the bottom edge of slot 32'' in slotted cross-member 20; however, no member forms a top edge of slot 32'', so that it is open-ended at its top.

From FIGS. 5A and 5B, it can also be seen that the overlapping of side wall cross-members is done in such a manner that upper cross-members always overlap the outer face of lower cross-members.

FIG. 6 illustrates, in exagerated form, the draft of the side edges of slots 32. The side edges of all slots are tapered one degree from the vertical. The edges of exterior slots 32' are tapered so that the slot is wider at the bottom than at the top because slots 32' will be lifted from the cavity die. Slots 32'', on the other hand, are tapered so that the top is wider than the bottom because the core die will be raised from slots 32''. The draft of the edges of slots 32 need only be one degree, shown as dimension B in FIG. 6.

By means of the above-described construction, the Hand Carrying Basket of the present invention accomplishes the stated objectives in a manner which is unobvious over the prior art. The strength of the basket's side walls is maintained both by including a corrugated cross-member and by overlapping the corrugated cross-member, above and below, with an unslotted, substantially planar cross-member. Weight reduction results from thinning the side walls and from forming slots in them. This also tends to reduce the cost of the baskets. Notwithstanding the thinness of the side walls, a basket having a large interior volume may be molded, using walls of relatively shallow draft, by means of the present invention.

I claim:

1. An integrally-formed plastic basket including a bottom wall and a plurality of outwardly tapering side walls defining an opening, each of said side walls comprising:

a corrugated cross-member having first panels lying generally inward of a centerline of said corrugated cross-member and including first slots and second panels lying generally outward of the centerline of said corrugated cross-member and including second slots;

an unslotted, substantially planar upper cross-member contacting the upper edge of said corrugated cross-member and forming a top edge of said second slots, said second slots having no bottom edge; and an unslotted, substantially planar lower cross-member contacting the bottom edge of said corrugated cross-member and forming a bottom edge of said first slots, said first slots having no top edge.

2. The basket of claim 1 comprising a plurality of said corrugated cross-members, each of said corrugated cross-members contacting an unslotted, substantially planar cross-member at its upper edge and an unslotted, substantially planar cross-member at its bottom edge.

3. The basket of claim 1 wherein said bottom wall is formed of intersecting ribs defining spaces therebetween.

4. The basket of claim 1 wherein said side walls further comprise a rolled top edge.

5. The basket of claim 1 wherein said side walls taper outwardly no more than 3° from the vertical.

6. The basket of claim 2 wherein said side walls taper outwardly no more than 3° from the vertical.

* * * * *